United States Patent [19]

Bicocchi

[11] Patent Number: 4,512,566

[45] Date of Patent: Apr. 23, 1985

[54] AUDIO-VISUAL DEVICE FOR GYMNASTIC IMPLEMENTS

[76] Inventor: Eugenio Bicocchi, Via Leopoldo Nobili, 10, Reggio Emilia, Italy

[21] Appl. No.: 441,236

[22] Filed: Nov. 12, 1982

Related U.S. Application Data

[63] Continuation-in-part of Ser. No. 101,907, Dec. 10, 1979, abandoned.

[30] Foreign Application Priority Data

Dec. 13, 1978 [IT] Italy ..... 46918 A/78

[51] Int. Cl.[3] ..... A63B 69/16

[52] U.S. Cl. ..... 272/72; 272/129; 272/73; 73/379

[58] Field of Search ..... 272/16, 18, 69, 70, 272/72, 73, 93, 128, 129; 273/DIG. 28; 73/379; 352/132

[56] References Cited

U.S. PATENT DOCUMENTS

| | | | |
|---|---|---|---|
| 3,765,245 | 10/1973 | Hampl | 272/73 |
| 3,930,495 | 1/1976 | Marino, Jr. | 272/73 |
| 4,141,630 | 2/1979 | Emmons | 272/18 |
| 4,278,095 | 7/1981 | Lapeyre | 272/69 |
| 4,298,893 | 11/1981 | Holmes | 272/73 |

FOREIGN PATENT DOCUMENTS

| | | | |
|---|---|---|---|
| 159030 | 12/1979 | Japan | 273/DIG. 28 |
| 159030 | 12/1979 | Japan | 273/DIG. 28 |

*Primary Examiner*—Richard C. Pinkham
*Assistant Examiner*—Leo Picard
*Attorney, Agent, or Firm*—McAulay, Fields, Fisher, Goldstein & Nissen

[57] ABSTRACT

An audio-visual device for exercising machines including a picture projector fixed on the machine at such a position that the pictures or images can be seen by the user; and optionally, a sound system built in the projector; a picture feeding device, a current tap for supplying electrical energy to the projector; the picture feeding device, and the sound system, if present; a device for sensing the speed of the machine, applied to a moving member of the machine and transmitting the energy produced by the motion of the moving member to the picture feeding device; wherein a changeover switch is provided for connecting, as desired, the picture feeding device either to an electrical energy source or to the device sensing the speed of the exercising machine.

18 Claims, 5 Drawing Figures

AUDIO-VISUAL DEVICE FOR GYMNASTIC IMPLEMENTS

CROSS-REFERENCE TO CO-PENDING APPLICATION

This application is a continuation-in-part of application Ser. No. 101,907, filed Dec. 10, 1979, and now abandoned.

FIELD OF THE INVENTION

This invention relates to an audio-visual device for exercising machines such as physiotherapeutic bicycles, relaxing cots or couches with pedaling mechanism, rowing machines and the like. At present exercising machines are very widely used both for medical purposes and for physical training.

THE PRIOR ART

The use of exercising machines, while assuring very good results in limb re-education, preventive therapy, physical training and the like, suffers, however, from the disadvantage of being somewhat tedious and troublesome.

This is the reason why a user very often quickly renounces the use thereof, or only intermittently uses the machines.

Basically, this is because such machines are commonly used in enclosed areas, such as, for example, gymnasiums, or physical rehabilitation clinics, and the users are forced to perform repeated, tedious and similar movements, which in time cause them to lose their concentration. While the exercises provide an evident physical benefit, the resulting loss of concentration may cause psychological damage to the user.

DESCRIPTION OF THE PRIOR ART

The art to which this invention relates includes U.S. Pat. Nos. 3,511,097; 3,744,794; 3,454,942 and 4,169,588. The first of these discloses a bicycle-like device which is pedalled by a user to rotate the armature of a generator, whose output energizes electronic circuitry in which means are provided to indicate the rate at which the user expends food calories during an exercise period.

U.S. Pat. No. 3,744,794 shows a restraint system for securing a user to an ergometer while exercising under zero gravity conditions.

U.S. Pat. No. 3,454,942 describes an exercise machine performance evaluation device for use with an activity mechanism and having two aligned display channels with first and second indicators disposed adjacent respective ones of the channels, apparatus for advancing the first indicator continuously at a fixed rate for a given period of time and a second apparatus responsive to a series of performance inputs for advancing the second indicator periodically to provide an indication of performance as a function of time indicated by the first indicator.

U.S. Pat. No. 4,169,588 is directed to an electronic exercising machine which gives a jogger a visual indication relative to a pre-set reference jogger.

As will be shown hereinafter, none of these teach or suggest the present invention.

THE INVENTION

It is the object of the present invention to provide an audio-visual device applicable to exercising machine, such as, for example, physiotherapeutic bicycles, rowing machines, relaxing cots or couches with pedaling mechanism and the like, featuring means for keeping a user's mind interested in the exercise activity through pictures and/or sound effects.

It is another object of the invention to provide an audio-visual device for exercise machines whose operation may be made dependent on the effort or speed with which the user acts on the machines or independently thereof.

It is a further object of the invention to provide an audio-visual device which is readily installed on any type of suitable exercising machine and which can be easily used both for psychological stimulus and for relaxation, while remaining of reduced manufacturing cost.

These and further objects according to the invention are achieved by an audio-visual device for exercising machines comprising a projection apparatus of pictures or images, optionally provided with a sound system, the machines being either an exercycle, a rowing machine, a relaxing cot or couch with pedaling mechanism, or other similar exercise apparatus, in such a position thereon that the projected images or pictures are visible by the user. In addition to being provided with connections to household current or with a self-contained battery, the machine of the invention is provided with a pick up applied to a moving member thereof which is connected to and drives the picture or image feeding device of the projection apparatus relating the feeding speed thereof to that with which the moving member is moved by the user.

Other objects, advantages and the nature of the invention will become readily apparent from the detailed description of the invention.

BRIEF DESCRIPTION OF THE DRAWINGS

In order that the present invention may be more clearly understood, a detailed description will now be given of preferred embodiments thereof, with reference to the accompanying drawings, in which.

DESCRIPTION OF THE PREFERRED EMBODIMENTS

Figure 1:
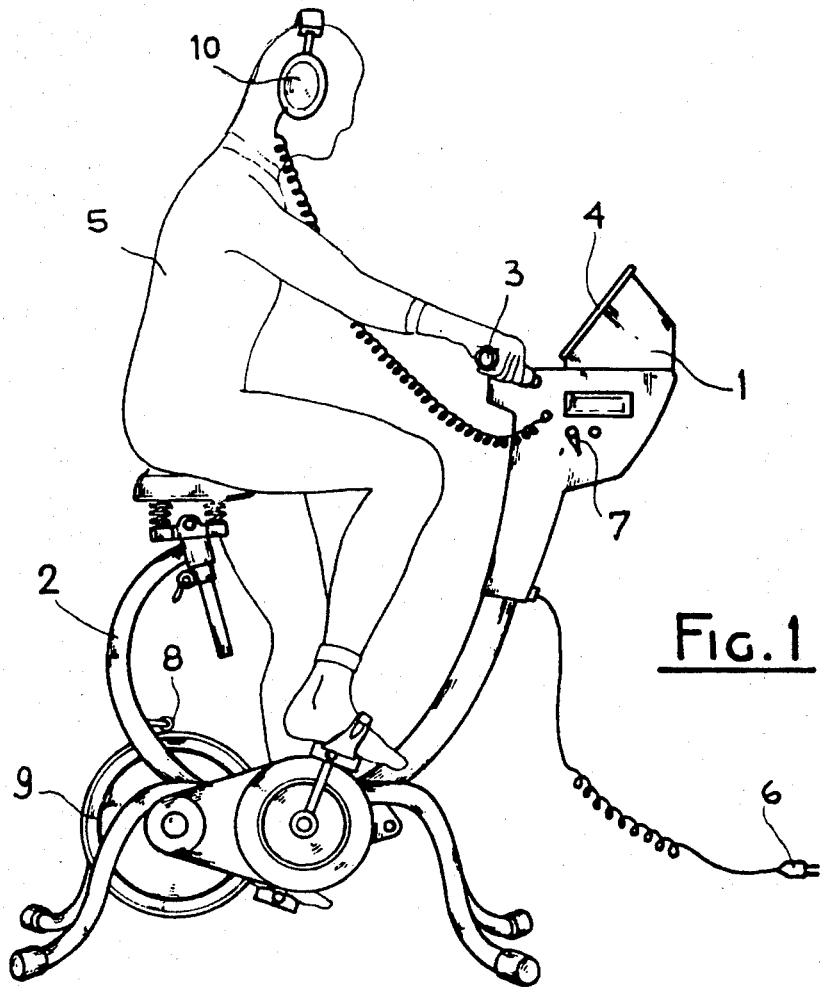
FIG. 1 is a view schematically showing an exercycle provided with audio-visual apparatus fixed centrally of the handle bar.
Figure 2:
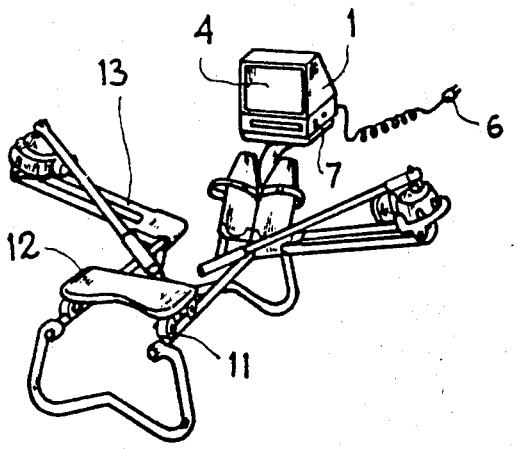
FIG. 2 is a view schematically showing a rowing machine also provided with audio-visual apparatus.

Reference is now made in detail to the accompanying drawings which illustrates the best mode presently contemplated for carrying out the invention, an audio-visual device 1, as best seen in FIGS. 1 and 2 is fitted onto an exercycle or pedaling machine 2. The device is fixed centrally of the handle bar 3, so that the screen 4 thereof faces toward the user's eyes. The device 1 may in general be a standard motion-picture projector, a stereopticon lantern, a video recorder, a cartridge projector, or any other known apparatus for the transmission of pictures on a screen or acoustical signals, such as for example music, talking comments, rhythmical noises and the like. Earphones 10 may also be associated with device 1 and coordinated with screen 4 to provide for audio sound coordinated with the material on screen 4.

In the illustrated embodiment, the audio-visual device 1 is connected to a source of current by a standard current tap 6, which supplies the lamp of the optical system for picture projection on the screen, the listening devices of the relevant soundtracks and the picture feeding system.

Using switch 7, the picture feeding device can be disconnected from the electric source or stand-by battery and connected to one of the devices to be hereinafter described.

One of these devices is substantially a mechanical type of device.

On the external periphery of the flywheel 9 of pedaling machine 2, a crown gear is provided with a sprocket 8 meshing therewith.

Figure 3:
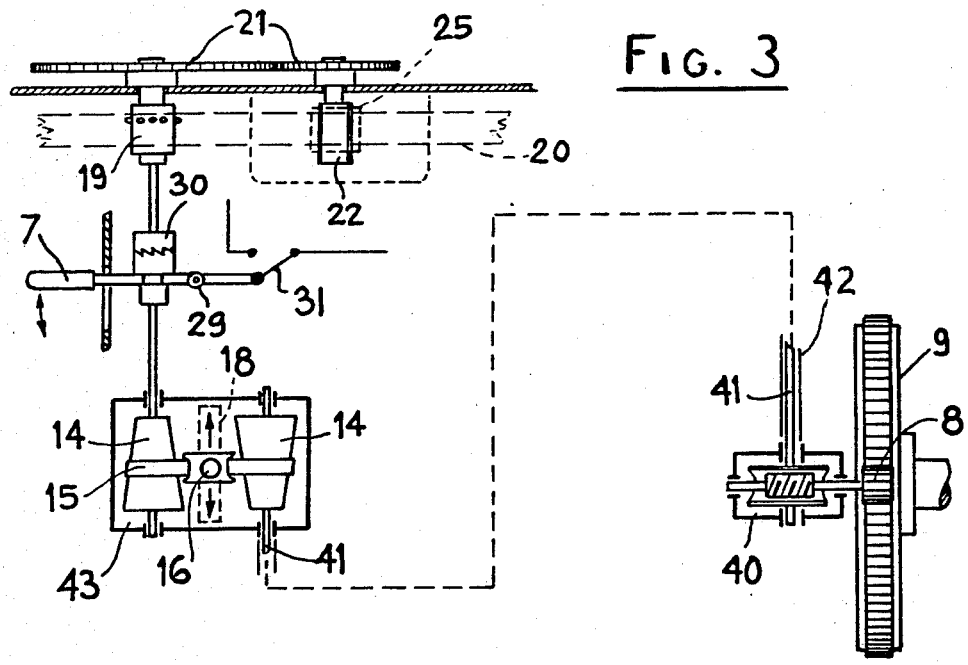
FIG. 3 is a diagrammatic showing in plan view of an example of a projection device, in which the feeding thereof is mechanically controlled by means of the rotary motion of the flywheel of the exercycle, independently of an optional sound transmission device.

Referring now in particular to FIG. 3, sprocket 8 transmits, through a worm screw-helical gear coupling 40, its rotary motion to a sheathed flexible cable 41. This cable 41, expousing or generally following the frame of bicycle 2 outwardly or located inwardly of the tubular element 42, is at its end connected to a stepless speed change gear 43. This change gear comprises two conical and opposite pulleys 14 connected by a belt 15. It may be positioned on a fork connected to a control or drive lever 16.

The lever 16 projects from the control board 17 located on the cycle handle bar.

The outlet of change gear 43 is connected to sprocket 19 drawing film 20 of a picture projector of a type similar to the normally used for moviolas.

Figure 4:
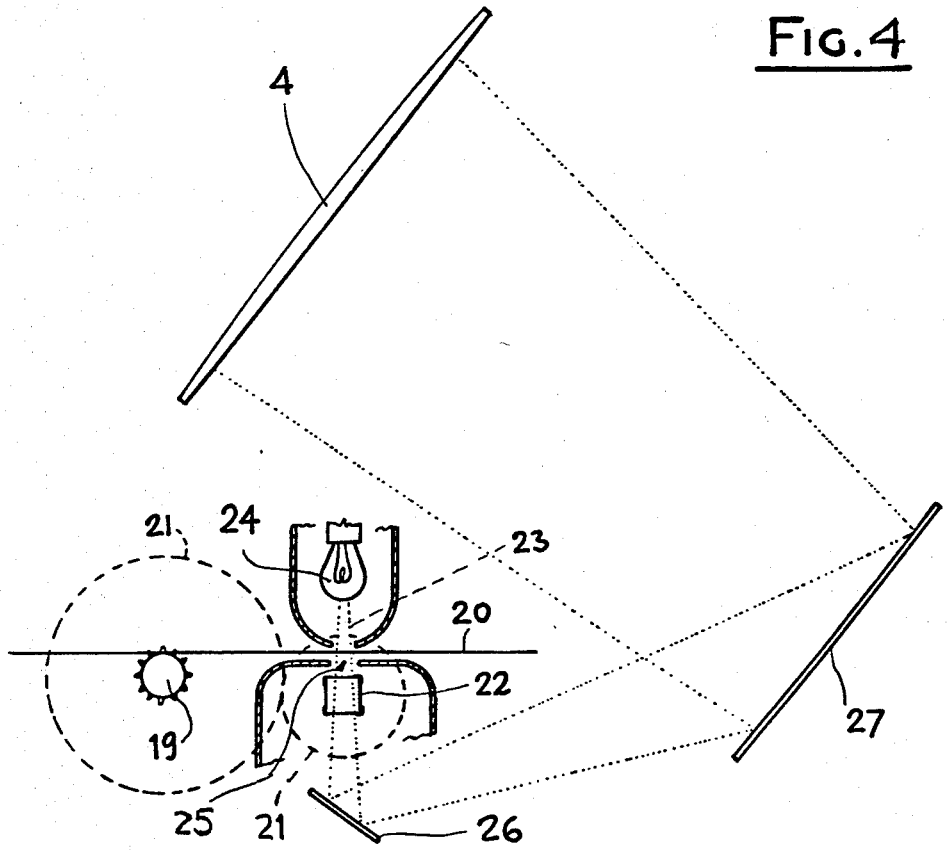
FIG. 4 is a diagrammatic showing in side elevational view of the projection device of FIG. 3.

As best seen in FIG. 4, in addition to drawing the film 20, sprocket 19 by means of a pair of gears 21 causes rotation of prism 22, through which (intermittently) light beam 23 from light source 24 projects a film image or picture passing in front of film trap 25 an underlying mirror 26, from which it is projected onto the screen 4, optionally, by means of additional mirror 27.

Source 24 is supplied with current by means of current tap 6 or a battery, and the picture feeding is controlled by the action on pedals 28 provided by user 5. The higher or lower feeding speed of the pictures projected onto screen 4 is thus proportional to the greater or less energy the user exerts on the pedals, and it is controlled and operated by the action of the user.

The stepless speed change gear 43 is used by the user 5 to adjust the feeding rate of the projected pictures optionally with a sound track, transmitted by a standard tape recording apparatus, not shown or described because it is of known type.

The changeover switch 7 may be provided by a lever pivoted at 29 and on one side connected to a mechanical gear coupling 30 and at the other end to a switch 31.

When this lever is positioned as shown in FIG. 3, coupling 30 mechanically connects the outlet of the stepless speed change gear 43 to the drawing sprocket 19.

When changeover switch 7 is lowered, coupling 30 is disconnected and switch 31 is closed.

Switch 31 is inserted in the electric circuit of the projector 1, which is thus supplied through the current tap 6.

In the first position, the picture feeding device is of the mechanical type and is directly controlled by the effort exerted by the user on pedals 28, while in the second position this device is controlled by house current or a battery and is independent of the user's action.

In any case, the sound system is independent of the picture feeding control, or comprises a standard recorder. Where an electrical supply is present, the picture projector can be of the sound type.

Figure 5:
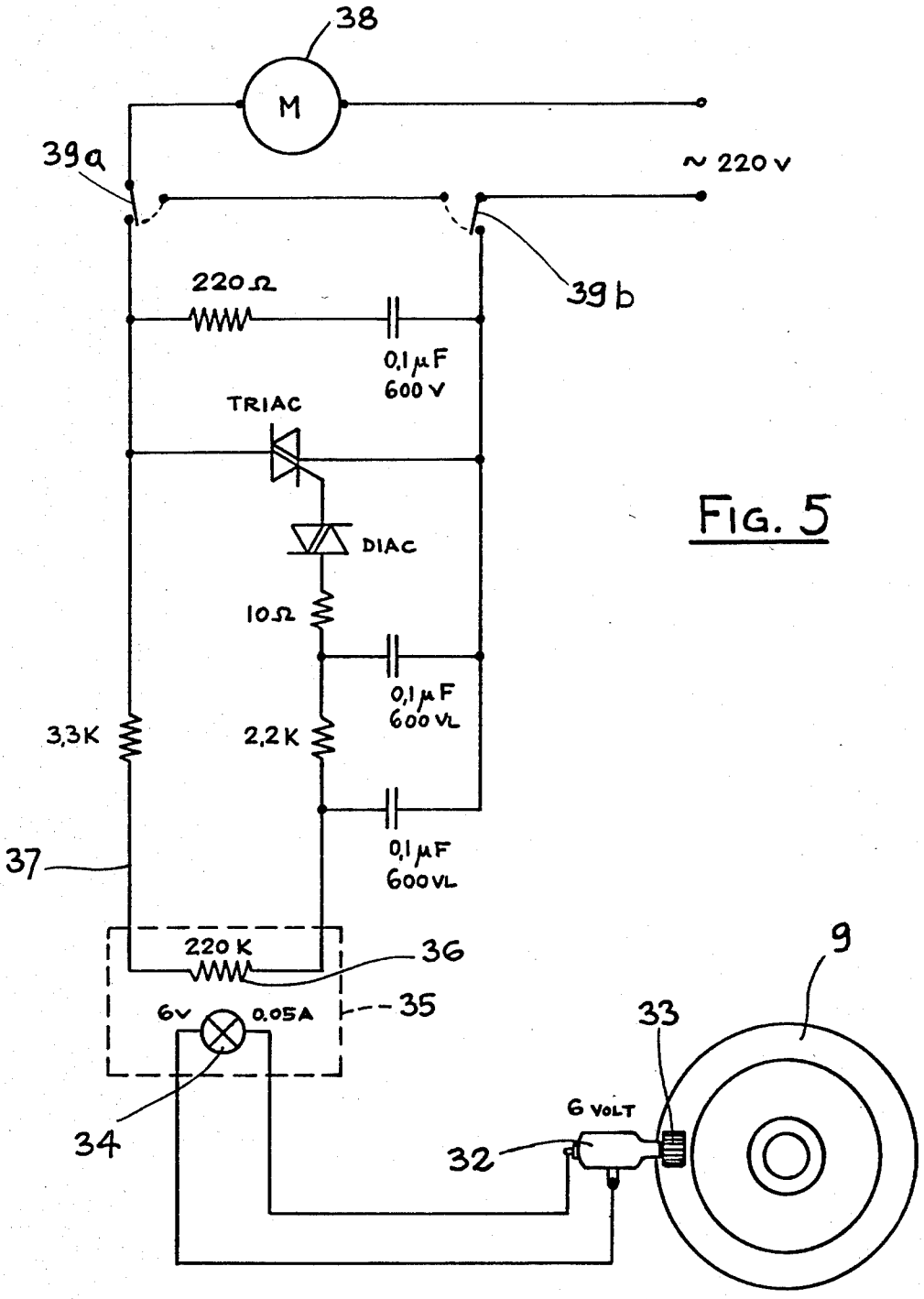
FIG. 5 is a circuit diagram of a second embodiment, in which the picture feeding is regulated and made proportional to the speed of rotation of a dynamo or generator, operated by the flywheel of a pedaling machine, supplying a lamp transmitting its light pulses to a photoresistor adjacent thereto, and inserted therewith in a optical insulator.

A second device for controlling the picture feed of a projector, depending on the user's action and not on the supply voltage, is shown in FIG. 5.

This device is obtained by a dynamo or generator 32, the armature of which is driven by a friction wheel 33, frictionally actuated by the flywheel 9 of a pedaling machine.

The dynamo or generator must be capable of generating a voltage of 6–7 volts, sufficient to operate lamp 34.

To this end, it is required that the radius of the friction wheel 33 and that of the flywheel 9, at the contact location with the wheel, be related to each other so that the revolutions of the wheel 33 are such as to cause the dynamo or generator to generate the desired voltage.

The above-mentioned lamp 34, inserted in an optical insulator of black plastics 35, transmits its light signals to the photoresistor 36.

By means of a known type of circuit 37, the photoresistor 36 adjusts the speed of the projector motor 38 as a function of and proportional to the transmission speed of the light signals of lamp 34, that is, in proportion to the speed of rotation of the dynamo or generator 32.

For illustrative purposes, the basic components of circuit 37 are shown in FIG. 5 with the relevant characteristics of the individual components.

The characteristics of circuit 37 may be varied as a function of the voltage capable of being furnished by the dynamo or generator 32. And, in case of photoresistor characteristics, the relative arrangements as to the circuit 37 provide the most satisfactory results, both from a functional standpoint and from an economical standpoint, and because the circuit is supplied by normal household electrical source by means of current tap 6. For voltages, different from normal household voltage and current source, a standard transformer may be inserted in the circuit according to known techniques, or the characteristics of the various components can be suitably modified. While a source of 220 volts is shown in FIG. 5, it will be obvious that any other conventional source may be used.

The projector motor 38 must be of adjustable type by TRIAC, that is with D.C. brushes.

In this second embodiment, the changeover switch 7 comprises a dual switch **39*a*, 39*b* by means of which the circuit 37 may be cut off or inserted in the supply circuit of motor 38**.

Also, in this case, the sound system is preferably independent of the picture drawing control, and this in order to avoid unacceptable distortions. Where a source of electric supply is used, the picture projector can also be of the sound type.

Independent silent films, silent films coupled with sound comments provided by independent soundtracks, or films provided with proper soundtrack may be used depending on availability.

Owing to the possible combinations of components, a user may use the exercise machines on which the audio-visual device according to the present invention is applied in different ways, depending on what such a user desires or requires. Thus, the user 5 in addition to proportioning his efforts on the pedals to perform the desired training, or the effort required by the medical treatments, may act on the pedals by constant gradual variable or programmed actions in accordance with the film, with or without soundtrack, inserted in the apparatus 1.

By this principle, it clearly appears that sound or silent films may be used with topics particularly suitable to provide a dual goal for the user.

Moreover, films can be used, which relate, for example, to bicycle racing, to a series of medical nature for scanning the action of patients who must undergo preventive or therapeutic exercises or to entertainment films relating to a certain action of the user of the pedals, and so on.

When changeover switch 7 is inserted into the electric current supply, then the user can perform his exercises in self-governing manner. This is in order to permit the use of the exercising machine also to those who during exercise desire, for example, to be diverted by relaxing films, study a foreign language, watch a sporting event or a lecture which occurred earlier and was suitably recorded (this in case the apparatus 1 is a video-recorder).

Where the user should desire to be completely isolated from the outer environment, the apparatus 1 is provided with a suitable connection for headphones 10, the connections of which to the transmitting apparatus used, such as recorders, video-recorders, sound projectors, are not here shown and are well known.

Instead of being provided with a normal screen 4, the machine 1 could also be provided with facilities for picture projection on an external screen of larger size. From the embodiment shown in FIG. 4, this could be obtained by a series of suitably oriented mirrors 27.

FIG. 2 shows a second application of the audio-visual device, having the previously described characteristics, except for the type of pick up or control sensor of the independent feeding devices. In this case, the pick up or sensor may be connected to a wheel 11 of a sliding dolly or carriage 12 of rowing machine 13 and can transmit a constant electric signal to the apparatus 1 apart from the to and from reciprocating movement of the dolly or carriage 12, owing to the application of a flywheel mounted on a free release device coaxial with the axis of said wheel 11. With the rowing machine, the projector may also be of stereopticon lantern type, wherein the picture change is provided by a known type of button actuated by an end of stroke member located at the end of a sliding rail for wheels 11. The films used here may be of technical-sporting nature, or may show rivers with time striking helmsmen, or be of general nature with relaxing pictures or with a plot free of the events.

In addition to being used on exercycles and rowing machines, an audio-visual device according to the present invention can be also used associated with other similar gymnastic apparatus, such as for example, relaxing cots or couches with pedaling mechanism and the like.

While there has been shown what is presently considered to be the preferred embodiments of the invention, various changes and modifications may be made without departing from the scope of the invention.

I claim:

1. An exercise machine comprising:

a movable member moved by the user during exercise;

an audio-visual device visible to said user and provided with a picture or feeding image device;

an external source of current for supplying electrical energy to said audio-visual device;

power source means for sensing the speed of said movable member is a user powered generator comprising a sprocket applied to a flywheel of said exercise machine, a stepless speed-change gear connected through a worm gear-helical wheel coupling a flexible cable to said sprocket, and a film drawing sprocket connected to said stepless speed change gear; and switch means for connecting said picture or image feeding device to said external source of current or to said power source means for sensing the speed of said movable member.

2. The exercising machine of claim 1, wherein the machine has a control means and wherein said stepless speed change gear comprises two opposite conical pulleys connected by a belt; and a fork connected to said control means for adjusting the position of the belt on said two pulleys, said control means being a control or a drive lever arranged on the machine.

3. The exercising machine of claim 1, wherein said film drawing sprocket causes the rotation of a prism projecting light beams from a light source onto a series of mirrors to project an image or picture onto a screen.

4. The exercising machine of claim 1, wherein said switch includes a lever, one end of said lever being pivoted and connected at one end to a mechanical gear coupling connecting said stepless speed change gear to said drawing sprocket, and the other end of said lever being connected to another switch forming part of an electrical circuit.

5. The exercising machine of claim 1, wherein said machine is a rowing machine having a wheel and wherein said speed sensing device is connected to the wheel of the rowing machine; a sliding carriage connected with said wheel; and means for connecting said speed sensing device to said audio-visual device.

6. The exercising machine of claim 5, wherein said picture projection apparatus is a stereopticon lantern; and said wheel of the sliding carriage and operated by said carriage cooperating with an end of stroke member located at the end of said sliding rail.

7. The exercising machine of claim 1, wherein said audio-visual includes an image device projector and a sound system;

said image-projector is a projector adapted to project images onto an external screen of a larger size by means of a series of oriented mirrors mounted on said machine; and said sound system includes loudspeakers and heaphones.

8. The exercising machine of claim 7, wherein said image projector and sound system are independent of each other.

9. In combination with an exercising machine having a user support and a transmission:

an apparatus including sensory projection means to produce audio signals and/or visual images mounted on said support in a position where such images can be seen by said user;

actuating means including an internal source of current associated with said transmission and powered by said user to transform the energy expended by said user into feeding rate of projected visual images;

stand-by energization means connected to an external source of current and to said projection means; and switch means connected with said actuating device and said projection means for disconnecting said actuating means from said projection means and connecting said projection means to said stand-by energization means to cause said projection means to be activated by the user and said internal source of current or by said external source of current.

10. The combination as claimed in claim 9, wherein said sensory projection means is a device operable in response to a preselected synchronous speed to provide an output proportional to speed, said device including a film projector, a video recorder, a slide projector or a magazine-loaded projector; and said actuating device including means responsive to the speed of operation of said actuating means; and said transmission including means to provide a constant output in synchronism with said synchronous speed in response to different pre-set speeds.

11. The combination as claimed in claim 9, wherein:

said machine is a physio-therapeutic cycle;

said transmission includes a flywheel and pedals to rotate said flywheel; and a pick-up device includes a friction roller operatively associated with said flywheel and said projection means to operate said projection means at a speed proportioned to the speed of rotation of said flywheel.

12. The combination as claimed in claim 9, including:

means to vary the speed of operation of said projection means to provide for the correct speed of operation for different speeds transmitted by said transmission; and said transmission including a flywheel and pedals connected with said flywheel for rotation thereof at different speeds;

said variable means being adjustable to provide for the same feeding rate of the projected pictures responsive to different energy levels imparted to said pedals so that a user pedals with a constant speed to provide for uniform operation of said projection means.

13. An exercising machine, comprising:

a movable member moved by the user during exercise;

an audio-visual device visible to said user;

a user support;

an external source of current for supplying electrical energy to said audio-visual device;

means for sensing the speed of said movable member to provide an internal source of power; means for transforming the motion of said movable member into mechanical energy to produce said internal source of power;

means for supplying electrical energy to said audio-visual device; and switch means for connecting said audio-visual device to said external source of current or to said means for transforming said motion into mechanical energy.

14. The machine of claim 13, wherein said means for sensing the speed of said movable member comprises:

a sprocket applied to a flywheel of said exercise machine a stepless speed change gear connected through a worm gear-helical wheel coupling and flexible cable to said sprocket, said stepless speed change gear comprising two opposite conical pulleys connected by a belt;

a fork connected to a control means for adjusting the position of the belt on said two pulleys, said control means being a control or a drive lever on the machine; and a film drawing sprocket connected to said stepless speed change gear, said film drawing sprocket causing the rotation of a prism projecting light beams from a light source onto a series of mirrors to project an image or picture onto a screen.

15. The exercise machine of claim 14, wherein:

said audio-visual device includes an image feeding device; and said image feeding device being supplied by either said external source of current or said means for sensing the speed of said movable member.

16. The exercise machine of claim 13, wherein said audio-visual device includes an image feeding device;

said image feeding device being connected to said switching means for supplying thereof by either said external source of current or said means for sensing the speed of said movable member.

17. The exercise machine of claim 13, wherein said audio-visual device includes an image feeding device; and said image feeding device being supplied by either said external source of current or said means for sensing the speed of said movable member.

18. An exercise machine comprising:

a movable member moved by the user during exercise;

an audio-visual device visable to said user and provided with a picture or image feeding device;

an external source of current for supplying electrical energy to said audio-visual device;

means for sensing the speed of said movable member comprising a generator having an armature driven through a friction wheel by a flywheel, a lamp connected to said generator and inserted in an optical insulator, a photoresistor connected to said optical insulator and a motor operated picture feeding device connected to said photoresistor, the speed of said motor being proportional to the transmission speed of the signals of said lamp; and switch means for connecting said picture or image feeding device to said external source of current or to said means for sensing the speed of said movable member.

* * * * *